United States Patent [19]

Yabase et al.

[11] 4,378,544

[45] Mar. 29, 1983

[54] DEFLECTION YOKE

[75] Inventors: Koji Yabase, Warabi; Kimiharu Shoji, Yokohama, both of Japan

[73] Assignee: Denki Onkyo Co., Ltd., Tokyo, Japan

[21] Appl. No.: 310,818

[22] Filed: Oct. 13, 1981

[30] Foreign Application Priority Data

Oct. 13, 1980 [JP] Japan ..... 55-145584[U]
Oct. 13, 1980 [JP] Japan ..... 55-145585[U]

[51] Int. Cl.[3] ..... H01F 7/00
[52] U.S. Cl. ..... 335/210; 335/213
[58] Field of Search ..... 335/210, 212, 213

[56] References Cited

U.S. PATENT DOCUMENTS 3,758,888 9/1973 Kadota .
4,065,738 12/1977 Elders et al. .
4,117,432 9/1978 Shizu ..... 335/213 X
4,246,560 1/1981 Shimizu et al. .
4,260,974 4/1981 Nelle ..... 335/213

*Primary Examiner*—George Harris
*Attorney, Agent, or Firm*—Armstrong, Nikaido, Marmelstein & Kubovcik

[57] ABSTRACT

The deflection yoke comprises a pair of horizontal deflection coils, a pair of vertical deflection coils which are toroidally wound around the annular core and a coil separator which separates both coils one from another. The winding guide frame which has the winding engaging members is fitted to both open ends of the annular core. By use of these winding engaging members, the vertical deflection coils are wound around the frame core so that the winding turns are concentrated at a partial region of the winding guide frame at the screen side and the winding turns are divided into two regions of the winding guide frame at the electron gun side, in the form of V-shape.

10 Claims, 9 Drawing Figures

DEFLECTION YOKE

BACKGROUND OF THE INVENTION

The present invention relates to the deflection yoke for use in a color cathode-ray tube in which three electron guns are provided in an in-line arrangement, particularly the side pin-cushionless self-convergence type deflection yoke through which three electron beams can be correctly converged all over the screen only with the deflection magnetic field generated by the deflection yoke.

Generally in case of a color television set which is provided a color cathode-ray tube in which three electron guns are in-line arranged, the deflection yoke for deflecting three electron beams is adapted to comprise a horizontal deflection coil which is formed so that the horizontal deflection magnetic field is of a pincushion type and a vertical deflection coil which is formed so that the vertical deflection magnetic field is a barrel type, whereby a proper picture is obtained only by the deflection field or the convergence device is simplified by producing such deflection magnetic field.

However, in the vertical deflection magnetic field as described above, a pincushion type distortion takes place at both horizontal end sides of the picture and becomes a large distortion due to a combination with the pincushion type distortion which results from the curvature of the fluorescent screen of the cathode-ray tube.

As a method to eliminate such pincushion type distortion, that is, the side pin-cushion distortion, the vertical deflection coil is wound so that the vertical deflection magnetic field generated from the vertical deflection coil is formed as a pincushion type at the screen side, that is, the front side of the deflection yoke and as a barrel type at the electron gun side, that is, the rear side of the deflection yoke. The deflection yoke of this construction is referred to as the side pincushionless self-convergence type deflection yoke.

For generation of the above-mentioned vertical deflection magnetic field, the vertical deflection coil which is to be toroidally wound around the annular core should be made as the V-shaped toroidal coil by concentratedly arranging the conductor in a narrow area at the screen side dividedly winding the conductor at two positions of the electron gun side as described in the U.S. Pat. No. 4,246,560.

In case of this method of winding, the conductor is wound with a constant tension applied during winding work and therefore the conductor slips at the edge of the core, thus unabling to position a number of turns of winding at the specified position of the edges of the core. In some cases, for this reason, the shape of the core is deformed as described in said U.S. patent but it is difficult to manufacture this type of core and obtain high dimensioned accuracy of the core and furthermore the deformation of the core brings about an unnecessary deformation of deflection magnetic field. As another example for materializing the above-mentioned winding method, a winding guide frame which is provided with a number of grooves in its periphery is fitted to the front edge and the rear edge of the core, respectively, to avoid slipping of the conductor as described in the U.S. Pat. No. 3,711,802. However, though this example of the core is extremely effective for positioning the conductor if the number of turns of winding is few, the V-shaped winding is undesirable due to a disorder of the winding turns resulting from that the conductors to be wound in a certain specified groove cannot be accommodated in that groove.

It is considered for eliminating such defect to deepen the grooves on the winding guide frame. While the grooves are provided in the plane passing through the core axis, the winding is wound around the core in the plane which does not pass the core axis, and therefore the conductor is obstructed by a wall between the grooves, and accordingly the winding cannot be effectively wound and a sufficient winding angle cannot be ensured, thus deteriorating the efficiency of winding work. Moreover, a bending stress is caused on the wall which forms the grooves by the tension applied to the winding during winding work and may break the wall.

The core which is provided with the vertical deflection coil as described above is mounted on the coil separator as in case of the conventional. If the deflection coil is toroidally wound in the V-shape, the turns of winding are convexed due to a small diameter of the core at the electron gun side, and accurate positioning and fixing of the core in reference to the coil separator cannot therefore be carried out.

SUMMARY OF THE INVENTION

An object of the present invention is to provide a deflection yoke which is free from a pincushion type distortion at the horizontal end sides of the picture and does not require a dynamic convergence coil device, wherein the vertical deflection coil is wound so that the pincushion type deflection magnetic field is produced at the screen side and the barrel type deflection magnetic field at the electron gun side.

Another object of the present invention is to provide a deflection yoke having a pair of vertical deflection coils which are wound around the frame core, which has a plurality of winding engaging members at both end parts of the annular core, without any deformation of the core so that the turns of the winding are concentrated at a partial region of the winding guide frame at the screen side and the turns of the winding are dividedly arranged at two regions of the winding guide frame at the electron gun side.

Further another object of the present invention is to provide a deflection yoke which is constructed so that the winding engaging members of the winding guide frame at least at the electron gun side of the winding guide frames mounted on both ends of the annular core are inclined in the direction of the turns of the vertical deflection coil to improve the efficiency of winding work and the density factor of winding turns in the winding grooves is improved.

Further another object of the present invention is to provide a deflection yoke which is constructed so that the vertical deflection coil which is toroidally wound around the core is accurately secured at the specified position of the coil separator whereby the relative position of the horizontal deflection coil in reference to the vertical deflection coil is determined.

The deflection yoke according to the present invention is provided with a pair of saddle-shaped horizontal deflection coils on the inside of the coil separator and a pair of vertical deflection coils, which are toroidally wound around the annular core, on the outside of the coil separator. Each half of the winding guide frame which has a plurality of winding engaging members is mounted on both ends of the split annular core, wherein the vertical deflection coils are wound in the V-shape around the frame cores so that the winding turns are concentrated at a partial region of the winding guide frame at the screen side and divided into two regions of the winding guide frame at the electron gun side. In this case, the winding engaging members of the winding guide frame of at least the electron gun side are inclined in the direction of winding turns and therefore the density factor of winding turns in the winding groove formed by two adjacent winding engaging members is improved and simultaneously the bending stress applied to the winding engaging member is reduced and the efficiency of winding work is improved. The winding guide frame at the electron gun side is provided with the engaging part between two regions where the vertical deflection coil is wound, and the vertical deflection coil is properly fixed at the specified position of the coil separator by engaging the engaging part with the positioning means provided on the coil separator and consequently the relative position in reference to the horizontal deflection coil is determined.

BRIEF DESCRIPTION OF THE DRAWINGS

The coil separator 4 is made up by combining split half parts made of a plastic material such as polypropyrene into a cylindrical unit. The coil separator has the front expanded part which incorporates the pommel part 42 of a pair of horizontal deflection coils, which is not shown, and the rear expanded in FIG. 6.

DETAILED DESCRIPTION OF THE INVENTION

Figure 1:
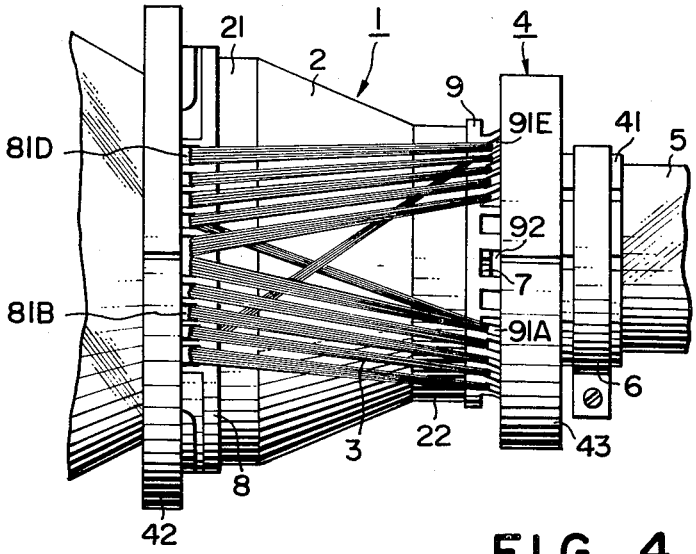
FIG. 1 is a general side view of the deflection yoke in accordance with the present invention which is mounted on the neck of the cathode-ray tube.

In FIG. 1, the deflection coil 1 is provided with a pair of vertical deflection coils 3 which are toroidally wound around the annular core 2 made of ferrite and arranged outside the coil separator 4 and a pair of horizontal deflection coils which are wound in the chamber which incorporates the cantle part of the coil and also has a pair of positioning projections 7, which support the electron gun side of the annular core 2, in a radial direction near the rear expanded chamber 43.

The annular frame core is made up by fixing the front annular winding guide frame 8 to the front open end part 21 with a bonding agent and similarly the rear annular winding guide frame 9 to the electron gun side or the rear open end part 22 with a bonding agent. The front winding guide frame 8 has the front winding grooves 81 which are concentrated at a part and formed by a plurality of winding engaging members while the rear winding guide frame 9 is provided with the engaging projections which form the engaging grooves 92, in the direction of the tube axis opposing to the winding grooves 81 of said front winding guide frame 8, into which the positioning projections 7 provided on the coil separator 4 are inserted, and with the rear winding grooves 91 which are formed by a plurality of winding engaging members in the circumferential direction at both sides. These engaging grooves 92, front winding grooves 81 and rear winding grooves 91 are provided symmetrically to the tube axis at a position in the radial direction of the winding guide frames 8 and 9.

Said annular core 2 is divided into two half cores by the plane passing through the tube axis in view of facilicating the winding work of the vertical deflection coil 3 and easy fabrication of the deflection yoke. Accordingly the annular winding guide frames 8 and 9 are divided into half guide frames which are respectively bonded to the half cores. When these half cores are joined together, the annular core is formed.

The vertical deflection coils 3 are wound in the V-shape so that a conductor is wound around the half core to both ends of which the half winding guide frame is fixed, through the winding grooves 81 and 91 from the direction of the plane which intersects the tube axis and is concentrated at a specified region of the front part of the core and divided into two regions of the rear part of the core.

Figure 2:
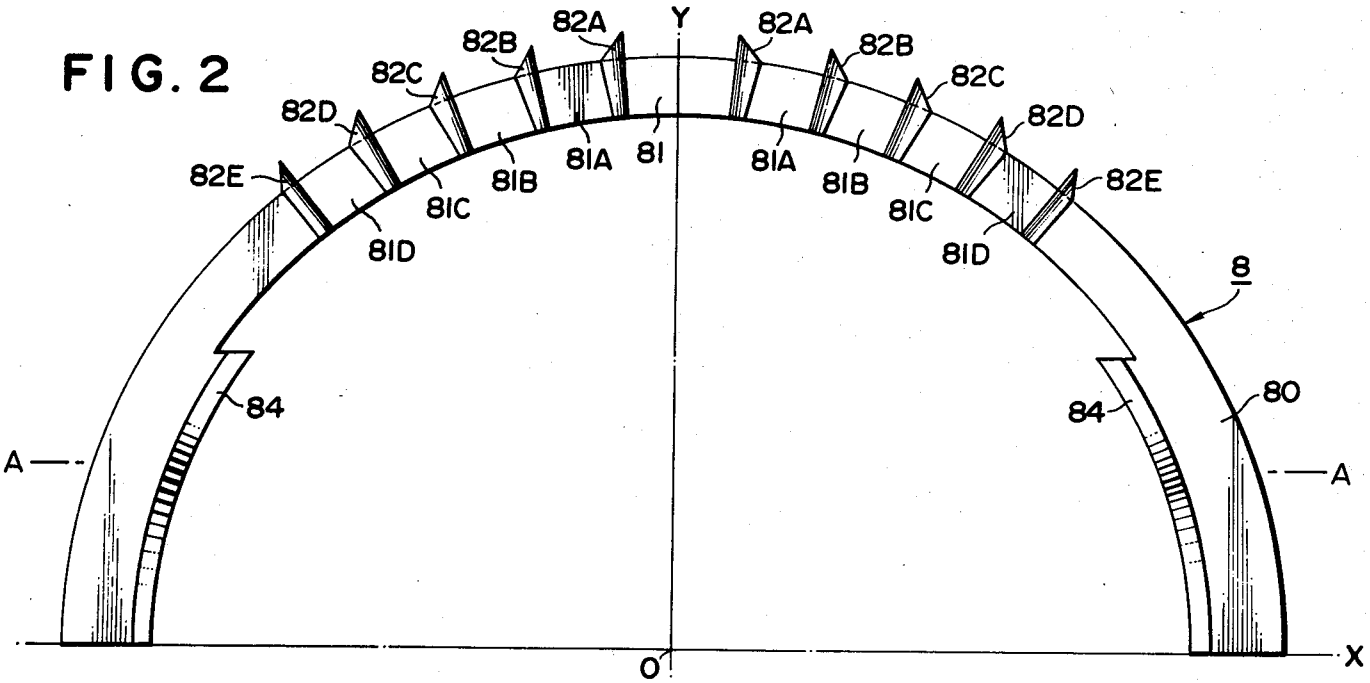
FIG. 2 shows a half of the front winding guide frame which is fixed at the screen-side end of the annular core of the deflection yoke shown in FIG. 1.
Figure 3:
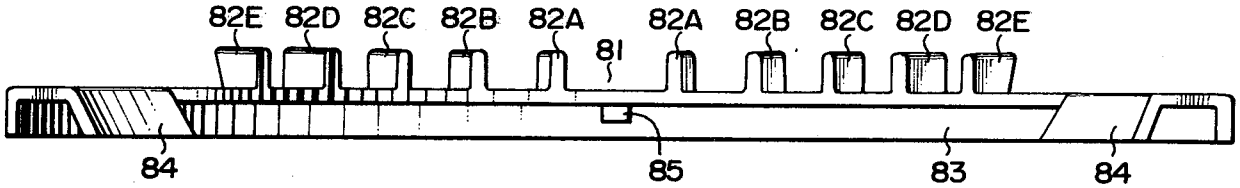
FIG. 3 is a side view of the half of the winding guide frame shown in FIG. 2 as viewed from the half of the other winding guide frame which is to be combined with the above half.

FIGS. 2 and 3 show the half of the front winding guide frame 8. Winding engaging members 82A, 82B, 82C, 82D and 82E are integrally provided with the semi-circular base plate 80 made of a plastic material such as, for example, denatured polyphenylene oxide resin and the flange part 83, on the outer periphery of the base plate 80 along the circumferential external surface of the core 2. The front winding groove 81 which is the center is formed between the winding engaging members 82A and 82A and other front engaging grooves 81A, 81B, 81C and 81D are formed by the winding engaging members 82A to 82E. Winding engaging members 82A are arranged with an angular interval $\theta 1$ against the perpendicular Y which passes through the tube axis O and divides the base plate 80 and other winding engaging members 82B to 82E are arranged at positions with angular intervals $\theta_2$, $2\theta_2$, $3\theta_3$ and $4\theta_2$ of approximately $\theta_1+4\theta_2<40°$ away from the winding engaging members 82A. The winding groove 81 is formed to be wider than others and the width of other winding grooves 81A to 81D is fixed as $l_1$. Accordingly, winding engaging grooves 82A to 82E have a wedge type cross section. The flange 84 is provided along the internal surface of the core 2 at both end parts of the internal periphery of the base plate 80. The projection 85 which engages with the recession of the core 2, which is not shown, to determine the position of the winding guide frame 8 in the circumferential direction of the core 2 is provided behind the winding groove 81 of the base plate 80.

Figure 4:
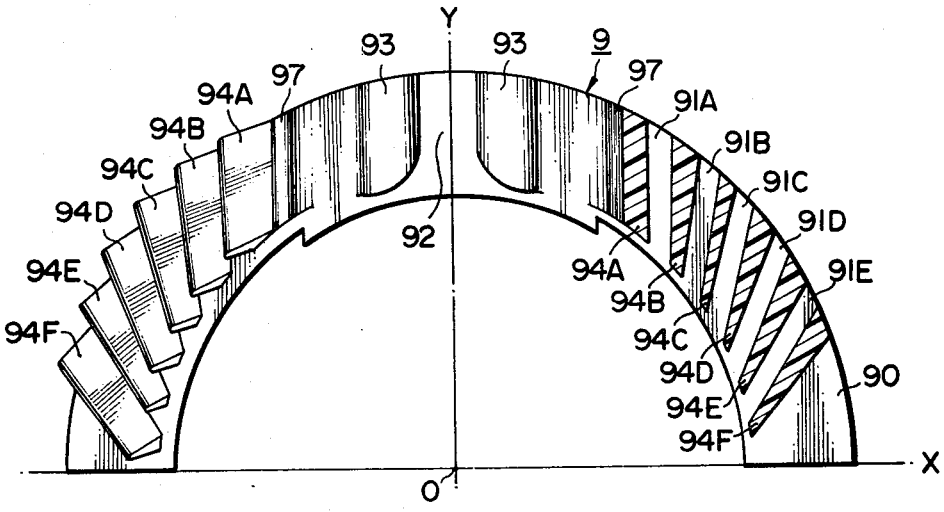
FIG. 4 shows a half of the rear winding guide frame which is fixed at the electron gun side end part of the annular core of the deflection yoke shown in FIG. 1.

FIG. 4 shows the half of the rear winding guide frame 9 which is partly shown as the cross section. The engaging projections 93, 93 which form the engaging groove 92 and the winding engaging members 94A, 94B, 94C, 94D, 94E and 94F which form the rear winding grooves 91A, 91B, 91C, 91D and 91E are formed integral with the base plate 90 made of a plastic material such as, for example, denatured polyphenylene oxide. A pair of engaging projections 93, 93 are arranged in parallel to the radial direction about the central part of the base plate 90 and have a construction with large thickness and internal curved surface to facilitate insertion of the positioning projection 7 into the engaging groove 92 and to ensure firm coupling of these parts. In reference to the plane formed by the internal periphery of the base plate 90, winding engaging members 94A to 94F are arranged so that the winding engaging member 94A is positioned with an angle $\theta_3$, for example, 45° against the perpendicular Y passing through the tube axis O which divides the base plate 90 and other winding engaging members 94B to 94F are positioned with certain specified angles $\theta_4$, $2\theta_4$, $3\theta_4$, $4\theta_4$ and $5\theta_4$ away from the winding engaging member 94A. Winding engaging members 94A to 94F are provided inclined in the Y-axis direction on the outer periphery of the base plate 90. In other words, the winding engaging member 94A has an angle $\theta A$ against the horizontal axis X passing through the tube axis O. Similarly, the winding engaging member 94B has an angle $\theta B$ and other winding engaging members 94C to 94F have the angles $\theta C$, $\theta D$, $\theta E$ and $\theta F$, respectively. These angles are denoted by, for example, an equation of $90° \geqq \theta A > \theta B > \theta C > \theta D > \theta E > \theta F \geqq 45°$. The winding grooves 91A to 91E are formed to have a certain specified width l2.

Figure 5:
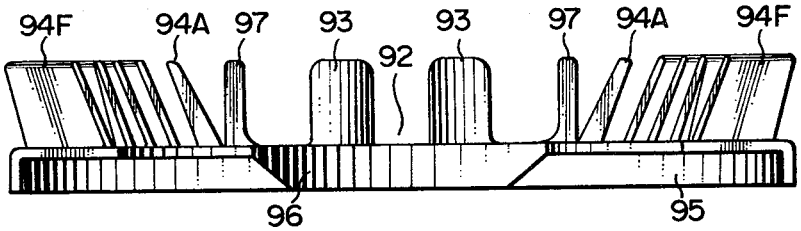
FIG. 5 is a side view of a half of the winding guide frame shown in FIG. 4 as viewed from the half of the other winding guide frame which is to be combined with the above half.

Moreover, the winding engaging members 94A to 94F are inclined in a direction where their extreme end parts are positioned to be gradually further away from the engaging projections 93, 93 by a certain specified angle $\theta V$ as shown in FIG. 5. The flange 95 along the circumference of the core 2 is provided on the outer periphery of the base plate 90 and the flange 96 which extends along the internal surface of the core 2 is provided beside the engaging projection 93 of the internal periphery of the base plate 90. The projection 97 provided beside the winding engaging member 94A serves to reinforce said member 94A. The angle $\theta V$ of inclination of winding engaging members 94A to 94F need not be the same as the angle of the winding turns of the vertical deflection coil and an angle suitable for winding work is selected from the range of 10°~45° in reference to the plane vertical to the base plate 90.

Figure 6:
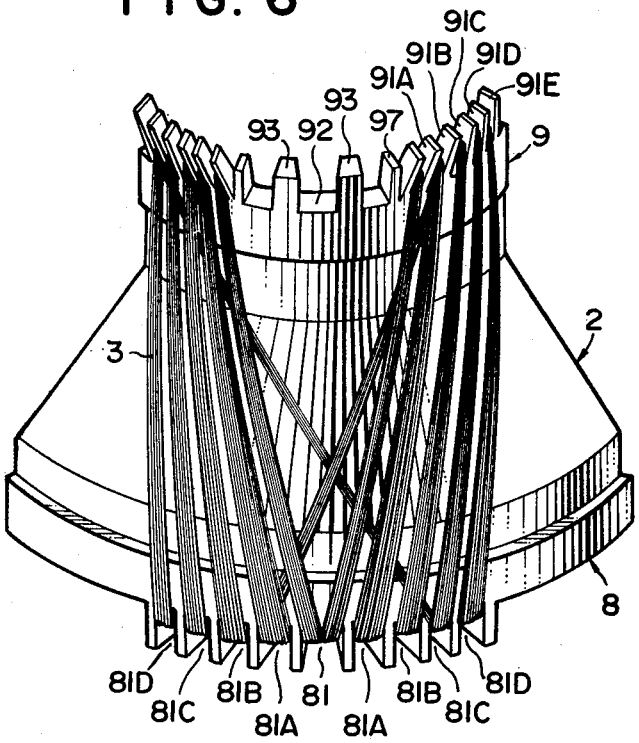
FIG. 6 is a perspective view of the vertical deflection coil of the present invention which is obtained by mounting each half of the winding guide frames shown in FIG. 2 and FIG. 4 on two split halves of the annular core and toroidally winding the conductor in the V-shape.

FIG. 6 shows one vertical deflection coil which is wound by bonding the half of the front winding guide frame 8 and the half of the rear winding guide frame 9 to the half of the core 2. The winding of the right-side half of the frame core is wound as many times as required so that the winding turns passing through the winding groove 91A of the winding guide frame 9 pass through the winding groove 81 of the winding guide frame 8, the winding turns of the winding groove 91B pass through the winding groove 81A, the winding turns of the winding groove 91C pass through the winding groove 81B and the winding turns of the winding groove 91E pass through the winding groove 81D. The winding of the left-side half of the frame core is also similarly wound. Accordingly, the vertical deflection coil 3 is certainly wound in the V-shape. In this case, winding engaging members 94A to 94F are inclined in the winding direction of the conductor and therefore not only the winding will not be impaired even though the winding engaging members have large dimensions but there are formed no spaces in which the conductor does not exist in the winding grooves 91A to 91E; thus the efficiency of winding work can be improved and the density factor of the winding grooves 91A to 91E can also be improved. A tension to be applied to the conductor during winding work is applied in series to the base plate 90 of the winding guide frame 9 and is hardly applied to the winding engaging members 94A to 94F and consequently a strong bending stress does not take place on the winding engaging members. For this reason, the winding turns are maintained at the initial position of the winding for a long period of time.

Figure 7:
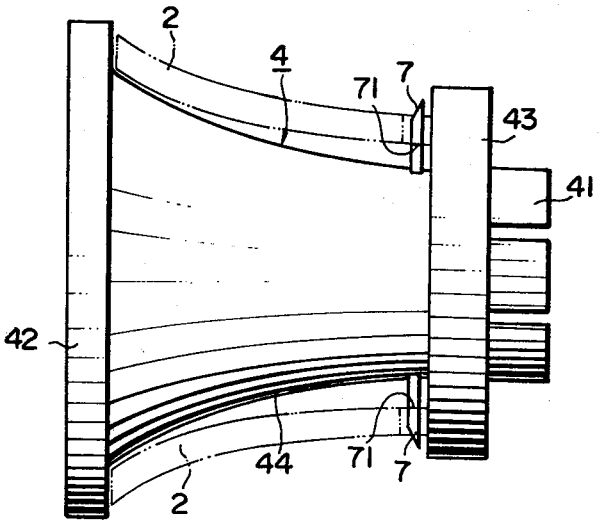
FIG. 7 shows the rough relative positions of the coil separator of the present invention which is provided with the positioning projection and a set of coils shown form of saddle, which is not shown, and arranged inside the coil separator 4, said horizontal deflection coils generating, for example, a pincushion type horizontal deflection magnetic field. This deflection coil 1 is mounted on the neck of the cathode-ray tube 5 and firmly fixed to the neck by clamping with the band 6 a plurality of lugs 41 which are formed along the neck surface at the electron gun side of the coil separator 4.

FIG. 7 shows the coil separator 4 in which the front expanded part 42 is provided at the larger diameter side of the flared part 44 and the rear expanded chamber 43 is provided at the smaller diameter side of the flared part 44. Two half parts divided by the plane passing through the tube axis are cylindrically joined together and used. A pair of positioning projections 7, 7 which project in the radial direction near the rear expanded chamber 43 of the flared part 44 to support the smaller diameter side of the core 2 which is toroidally wound as shown in FIG. 6 by the steps 71, 71 provided on the positioning projections 7, 7 as shown with a 2-dot broken line.

Figure 8:
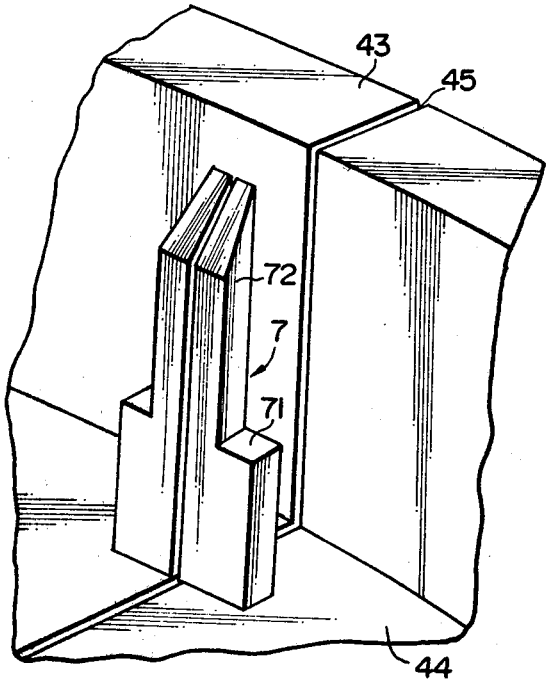
FIG. 8 is a magnified perspective view of the positioning projection of the coil separator shown in FIG. 7, and, FIG. 9 is a partly magnified perspective view illustrating the coupling state of the rear winding guide frame of the vertical deflection coil of the deflection yoke shown in FIG. 1 and the positioning projection.
Figure 9:
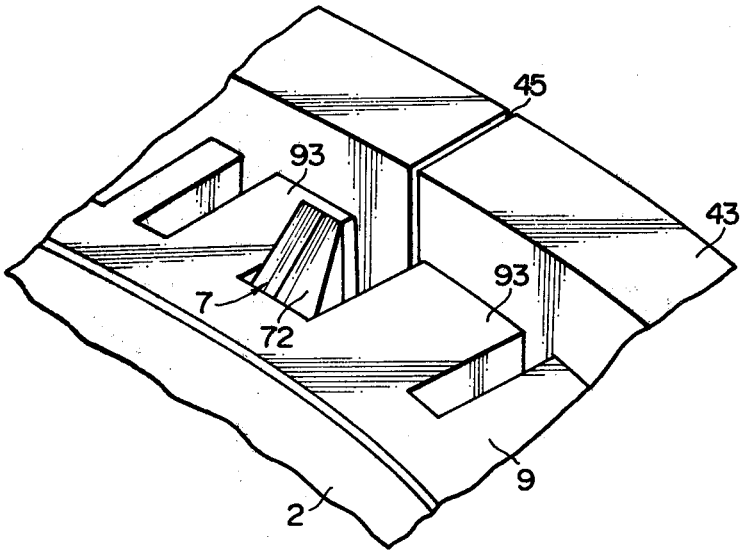

The positioning projection 7, as shown in FIG. 8, is formed along the joined surface 45 and comprises the step 71 on which the engaging projection 93 of the rear winding guide frame 9 is secured and the small end part 72 which fits into the engaging groove 92 of the engaging projections 93, 93. When the rear winding guide frame 9 is engaged with the positioning projection 7, the core 2 is fixed at the optimum position of the coil separator 4. Consequently, the relative position of the vertical deflection coils 3 to the horizontal deflection coils are optimized. As shown with the 2-dot broken line in FIG. 7, a space is formed at the smaller diameter side of the core 2 between the internal periphery of the core 2 and the flared part 44 of the coil separator 4; therefore even though the layer of conductor to be wound in the winding grooves 91A to 91E is locally thick on the internal periphery of the core, the core 2 can be fixed to the coil separator 4. As shown in FIG. 9, the half-divided coil separator 4 can be maintained bonded by engaging the positioning projection 7 with the winding guide frame 9.

In another embodiment of the present invention, the half part of said front winding guide frame 8 is shown as a semi-circular shape. Both ends of said half part can be cut at a certain specified length, for example, along the broken line A—A in FIG. 2 to save the plastic material. In this case, it is preferable that the flange 84 partly remains. Winding engaging members 82A to 82E of the front winding guide frame 8 which are provided to be perpendicular to the base plate 80 can be inclined in the direction of winding turns of the vertical deflection coils 3 as the rear winding guide frame 9. The convexty can be formed on the inside of the base plate 90 opposing the position of the winding engaging groove 92 of the rear winding guide frame 9 as on said winding guide frame 8 and can be engaged with the recession provided in the core 2. In this construction, a pair of winding guide frames 8, 8 need not to form a ring when combined.

Furthermore, each winding turn of the vertical deflection coil to be wound around the frame core can be wound through any of winding grooves 81 and 81A to 81D of said winding guide frame 8 and winding grooves 91A to 91E of the rear winding guide frame 9. For example, the winding turns passing through the winding groove 91E can be wound in the winding groove 81A and can be divided into the winding groove 81 and 81A to 81E. Selection of the winding grooves and the number of winding turns are determined by the characteristics of the vertical deflection magnetic field.

Furthermore, in the above embodiment, the number of winding grooves for the half part of the front winding guide frame is determined as 9 and the number of winding grooves 91A to 91E on two regions of the half part of the rear winding guide frame is determined as 5. These numbers of winding grooves can be slightly varied in accordance with the nature of design of the deflection yoke.

What is claimed is:

1. A deflection yoke which is used in a color cathode-ray tube having a screen and three electron guns in an in-line arrangement comprising:

(a) a pair of horizontal deflection coils which are wound, in a saddle shape, (b) a cylindrical coil separator which is divided into two half parts to be mounted on its inside with said horizontal deflection coils, (c) an annular core which is divided into two half parts and mounted on an external side of said coil separator, (d) half front winding guide frames which are fitted to the screen-side end parts of said pair of half-core parts and provided with a plurality of winding engaging members which are mounted on a partial circumferential region of each half-core part, (e) half rear winding guide frames which are fitted to the electron-gun side end parts of said pair of half-core parts and provided with a plurality of winding engaging members which are mounted on two partial circumferential regions of said half-core parts which are located with a certain specified distance and inclined in reference to a plane passing through a tube axis, and (f) a pair of vertical deflection coils which are toroidally wound on said annular cores to which said winding guide frames are fitted, by use of said winding engaging members, thereby generating a pincushion type vertical deflection magnetic field at the screen side and a barrel type vertical deflection magnetic field at the screen side.

2. A deflection yoke in accordance with claim 1 wherein said winding engaging members of said half front and rear winding guide frames are arranged in the circumferential direction of the core with a winding groove for accommodating a plurality of winding turns of vertical deflection coils between adjacent winding engaging members and said winding groove of at least said rear winding guide frames are inclined in reference to the plane passing through the tube axis.

3. A deflection yoke in accordance with claims 1 or 2, wherein the winding engaging members which are provided on two regions of said half rear winding guide frame are inclined in reference to a plane perpendicular to the tube axis.

4. A deflection yoke in accordance with claim 3 wherein both end parts of the half winding guide frame are cut off at a position outside the region which includes the winding engaging members of said half front winding guide frame.

5. A deflection yoke in accordance with claim 3, wherein the winding turns of said vertical deflection coils are wound from the winding grooves of the front winding guide frame to the winding grooves of the rear winding guide frame, approximately in the V-shape as a whole.

6. A deflection yoke which is mounted on a neck of a color cathode-ray tube having a screen and three electron guns in an in-line arrangement comprising:

(a) a pair of horizontal deflection coils which are wound in a saddle shape to provide a pincushion type horizontal deflection magnetic field, (b) a cylindrical coil separator for internally fitting said horizontal deflection coils, which is divided into two parts in the direction of a tube axis and provided with a cylindrical flared part and a front expanded part which accommodates a pommel part of said horizontal deflection coils at its screen side and a rear expanded chamber which accommodates a cantle part of said horizontal deflection coils at its electron gun side, (c) a pair of positioning means which are provided at a position in a radial direction on said flared part near said rear expanded chamber, (d) an annular core which is divided into two half parts and mounted on the external surface of the flared part of said coil separator, (e) half front winding guide frames which are mounted on the screen-side end parts of said pair of half cores and provided with a plurality of winding engaging members on a partial region in the circumferential direction of the half core, between which winding grooves are formed, (f) half rear winding guide frames which are mounted on the electron gun end parts of said pair of half cores and provided with a plurality of winding engaging members on two regions with a certain specified distance therebetween in the circumferential direction of said half core, between which the winding grooves are formed and inclined in reference to a plane passing through the tube axis, said winding engaging members being inclined in reference to a plane perpendicular to the tube axis, (g) a engaging means of said half rear winding guide frames which is provided to engage with a positioning means, between two regions on which the winding engaging members are provided, and (h) a pair of vertical deflection coils which are toroidally wound in a V-shape on half annular cores which are provided with said winding guide frames through said winding grooves, thereby a pincushion type deflection magnetic field is formed at the screen side and a barrel type vertical deflection magnetic field is formed at the electron gun side.

7. A deflection yoke in accordance with claim 6, wherein said positioning means is provided as a projection having a step and a small end part extended above from said step and said engaging means are formed as a pair of engaging projections which are provided on said rear winding guide frame toward the electron guns, said engaging projections being secured at said step and said small end part being inserted between said engaging projections.

8. A deflection yoke in accordance with claims 6 or 7, wherein the winding grooves of said half front winding guide frame include a wide center groove and adjacent grooves having a narrower width than said center groove.

9. A deflection yoke in accordance with one of claims 6, or 7, wherein said winding engaging members located in two regions of said half rear winding guide frame are inclined toward the center of the screen.

10. A deflection yoke in accordance with claim 9, wherein almost all winding turns of the winding which are wound through the nearest winding grooves to said engaging means on said half rear winding guide frames are wound in the center winding groove of said half front winding guide frame.

* * * * *